US006025107A

United States Patent [19]

Sekiguchi et al.

[11] Patent Number: 6,025,107

[45] Date of Patent: Feb. 15, 2000

[54] NEGATIVELY CHARGEABLE TONER FOR DEVELOPING ELECTROSTATIC LATENT IMAGES

[75] Inventors: Yoshitaka Sekiguchi; Tetsuo Sano; Kenichi Kido, all of Amagasaki, Japan

[73] Assignee: Minolta Co., Ltd., Osaka, Japan

[21] Appl. No.: 09/168,277

[22] Filed: Oct. 8, 1998

[30] Foreign Application Priority Data

Oct. 29, 1997 [JP] Japan ..... 9-296079

[51] Int. Cl.[7] ..... G03G 9/097

[52] U.S. Cl. ..... 430/110; 430/111

[58] Field of Search ..... 430/110, 109, 430/111

[56] References Cited

U.S. PATENT DOCUMENTS

| | | | |
|---|---|---|---|
| 4,588,668 | 5/1986 | Yasuda et al. | 430/109 |
| 4,626,487 | 12/1986 | Mitsuhashi et al. | 430/109 |
| 4,767,688 | 8/1988 | Hashimoto et al. | 430/110 |
| 4,863,824 | 9/1989 | Uchida et al. | 430/109 |
| 5,391,695 | 2/1995 | Kawabe et al. | 528/272 |
| 5,541,030 | 7/1996 | Sano et al. | 430/106.6 |
| 5,759,731 | 6/1998 | Hagi et al. | 430/106.6 |
| 5,776,647 | 7/1998 | Kido et al. | 430/110 |
| 5,814,428 | 9/1998 | Kido et al. | 430/110 |

FOREIGN PATENT DOCUMENTS

| | | |
|---|---|---|
| 3-112990 | 5/1991 | Japan . |

*Primary Examiner*—John Goodrow
*Attorney, Agent, or Firm*—McDermott, Will & Emery

[57] ABSTRACT

The negatively chargeable toner of the present invention comprises negatively chargeable toner particles including a boron compound, and exterior additive particles adhered to the surface of the toner particle and comprising hydrophobic silica particles and metal titanate particles, wherein the additive weight ratio of said hydrophobic silica particles and metal titanate particles is within a range of 5:1 to 1:1.2, and a total specific surface area S of the exterior additive particles is 40 to 120.

18 Claims, No Drawings

NEGATIVELY CHARGEABLE TONER FOR DEVELOPING ELECTROSTATIC LATENT IMAGES

RELATED APPLICATIONS

The present invention is based on Japanese Patent Applications No. 9-296,079, each content of which being incorporated by reference.

BACKGROUND OF THE INVENTION

1. Field of the Invention

The present invention relates to a toner for developing electrostatic latent images, and specifically relates to a negatively chargeable toner for use in digital type image forming apparatuses.

2. Description of the Related Art

Conventional image forming apparatuses are generally analog type image forming apparatuses such as used in copiers and the like wherein a document is illuminated by a light source and the light reflected from said document irradiates the surface of a photosensitive member so as to form an electrostatic latent image on the surface of said photosensitive member. Image forming apparatuses of the digital type are known wherein digitally written electrostatic latent image is developed by supplying a developer containing a toner to said latent image. Digital type image forming apparatuses have been practicalized in the forms of electrophotographic type facsimile apparatuses, digital copiers which form images based on image information read by an image reader, and printers using the output of computer terminals.

In image forming apparatuses of the digital type, an electrostatic latent image is formed in dot units on the surface of a negatively charged organic photosensitive member by digitally writing image data via irradiation of said surface by a laser beam or the like, this latent image is reverse developed by a negatively charged toner, and the obtained toner image is transferred onto a recording member and fused thereon to form a recorded image. The toner used in such digital type processes must have excellent dot reproducibility. That is, the toner must have a true reproducibility in dot units when developing an electrostatic latent image formed on the surface of a photosensitive member, and this reproducibility must not be reduced even after repeated use. To satisfy such characteristics, a toner must have excellent charge rise characteristics as well as excellent stability relative to charging. In the case of two-component developers, a toner is mixed with a carrier within the developing device so as to be triboelectrically charged; the toner must have charging characteristics such that a desired amount of charge is attained rapidly in a short mixing time, but thereafter the charge amount drops somewhat or does not increase even with additional mixing. The toner must have excellent charge stability relative to environmental fluctuations (temperature and humidity) and a rise in temperature in the image forming apparatus. The toner must have excellent characteristics that prevent toner-film-formation on the photosensitive member and decrease of thickness of the photosensitive member. Further, the toner must have excellent transfer characteristics from the photosensitive member to a transfer member.

SUMMARY AND OBJECTS OF THE INVENTION

An object of the present invention is to eliminate the aforesaid disadvantages by providing a negatively chargeable toner having excellent charge stability after repeated use.

Another object of the present invention is to provide a negatively chargeable toner having the aforesaid excellent charging characteristics and excellent black color reproducibility.

Another object of the present invention is to provide a negatively chargeable toner that eliminates the problems of filming.

Yet another object of the present invention is to provide a negatively chargeable toner which eliminates the problem of reduced image quality caused by heat fixing by suppressing dot breakdown during heat fixing.

A further object of the present invention is to provide a negatively chargeable toner having excellent charge stability relative to environmental fluctuations.

A still further object of the present invention is to provide a negatively chargeable toner having excellent transfer characteristics from an electrostatic latent image carrying member such as a photosensitive member or the like to a transfer member such as a paper sheet or the like.

The present invention relates to a negatively chargeable toner comprising:

negatively chargeable toner particles including a binder resin having an acid value of 5 to 50 KOHmg/g, a colorant, and a boron compound expressed by the chemical structural formula (A) below:

(A)

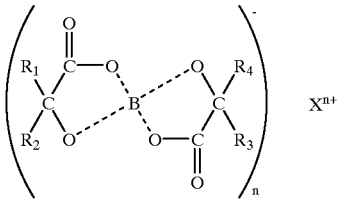

(Wherein $R_1$ and $R_3$ respectively represent substituted or non-substituted aryl group, $R_2$ and $R_4$ respectively represent hydrogen atom, alkyl group, substituted or non-substituted aryl group, X represents a cation, and n is an integer of either 1 or 2.); and exterior additive particles adhered to the toner particle surface, said exterior additive particles comprising hydrophobic silica particles and metal titanate particles, wherein the additive weight ratios of said hydrophobic silica particles and metal titanate particles is within a range of 5:1 to 1:1.2, the exterior additive total specific surface area S is 40 to 120 expressed by the equation (1) below:

$$S=Ss\times Vs+St\times Vt \quad (1)$$

(Wherein Ss is the specific surface area of the hydrophobic silica particles ($m^2/g$), Vs is the additive amount (percent-by-weight; hereinafter abbreviated as "wt %") of hydrophobic silica particles relative to toner particles, St is the specific surface area of the metal titanate particles ($m^2/g$), and Vt is the additive amount (percent-by-weight; hereinafter abbreviated as "wt %") of metal titanate particles relative to toner particles.

DESCRIPTION OF THE PREFERRED EMBODIMENTS

The negatively chargeable toner of the present invention includes a boron compound expressed by the chemical structural formula (A) below to improve charge rise characteristics and charging stability.

(A)

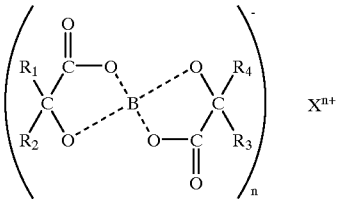

In the equation, $R_1$ and $R_3$ respectively represent substituted or non-substituted aryl group, $R_2$ and $R_4$ respectively represent hydrogen atom, alkyl group, substituted or non-substituted aryl group, X represents a cation, and n is an integer of either 1 or 2.

The previously described excellent effectiveness is accomplished by the inclusion of the aforesaid boron compound in a toner containing specific binder resin. That is, the toner has excellent negative chargeability before the inclusion of the boron compound, and is capable of maintaining a high negative charge. On the other hand, since this toner characteristically increases the amount of charge when mixed excessively, the inclusion of the aforesaid boron compound is believed to be effective in achieving excellent charging stability. The boron compound expressed by the chemical structural formula (A) has excellent safety characteristics inasmuch as it does not contain heavy metal.

Examples of usable cations represented by X in the aforesaid structural formula (A) include alkali metal ions such as lithium, potassium and the like, alkali earth metal ions such as magnesium, calcium and the like, hydrogen ion, ammonium ion, iminium ion, phosphonium ion and the like. The aforesaid boron compound is desirably added at a rate of 0.5 to 5 parts-by-weight, and preferably 1 to 3 parts-by-weight relative to 100 parts-by-weight (hereinafter parts-by-weight abbreviated to pbw) of binder resin. When the added amount of boron compound is less than 0.5 pbw, inadequate effectiveness is achieved, whereas when the added amount is in excess of 5 pbw, the amount of toner charge is reduced, causing the carrier to become spent too quickly when used in two-component developers.

Boron compounds possessing excellent characteristics will be colorless or white in color and, therefore disadvantageously reduce the degree of blackness of black toners. For example, the degree of blackness of the toner is reduced when using the aforesaid boron compound in place of azo compounds containing heavy metals such as chrome and cobalt and the like which are normally used as negative charge controllers because their color is black or a near-black dark color.

In the present invention, an acidic carbon black having a pH of 1 to 6, and preferably pH of 1 to 5, and more preferably pH of 1 to 4, so as to eliminate the aforesaid disadvantages. Such an acidic carbon black improves the degree of blackness by have excellent dispersibility relative a polyester resin having a specific acid value as described later. This carbon black also enhances the negative chargeability of the toner. Effectiveness is inadequate when an alkaline carbon black is used, and a reduced degree of blackness results using identical amounts compared to the use of acidic carbon black. The acidic carbon black content is desirably 6 to 12 pbw, and preferably 7 to 10 pbw relative to 100 pbw of binder resin. When the carbon black content is less than 6 pbw, inadequate effectiveness is achieved, whereas when more than 12 pbw are used, the toner charge is reduced so as to give rise to the disadvantages of toner fog and toner spillage. From the perspective of safety, it is desirable that the aforesaid carbon black should have a mean primary particle size of less than 40 nm, preferably 10 to 40 nm, and more preferably 15 to 35 nm.

The toner of the present invention desirably uses a binder resin including a polyester resin as the main component of the binder resin and having an acid value of 5 to 50 KOHmg/g, and preferably 10 to 40 KOHmg/g. Use of a binder resin having such an acid value improves the dispersibility of carbon black and boron compound, and produces a toner having sufficient negative charge. When the acid value is less than 5 KOHmg/g, the effectiveness is markedly reduced, and when the acid value exceeds 50 KOHmg/g, the stability of the toner charge amount is adversely affected by environmental fluctuations, especially temperature fluctuations.

The polyester resin used in the present invention may be a polyester resin obtained by a condensation polymerization reaction of a polyvalent alcohol component and polyvalent carboxylic acid component.

Examples of useful bivalent alcohol components among the aforesaid polyvalent alcohol components include bisphenol-A alkylene oxide adducts such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane and the like, ethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polytetramethylene glycol, bisphenol-A, bisphenol-A with added hydrogen and the like.

Examples of useful trivalent and above alcohol components include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and the like.

Examples of useful bivalent carboxylic acid components among the aforesaid polyvalent carboxylic acid component include maleic acid, fumaric acid, citraconic acid, itaconic acid, glutamic acid, phthalic acid, isophthalic acid, terephthalic acid, cyclohexane dicaroboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, and acid anhydrides or low-molecular alkyl esters thereof.

Examples of useful trivalent and above carboxylic acid components include 1,2,4-benzenetricarboxylic acid (trimellitic acid), 1,2,5-benzenetricarboxylic acid, 2,5,7-naphthalenetricarboxylic acid, 1,2,4-napthalenetricarboxylic acid, 1,2,4-butanetricarboxylic acid, 1,2,5-hexanetricarboxylic acid, 1,3-dicarboxyl-2-methyl-2-methylenecarboxy propane, 1,2,4-cyclohexanetricarboxylic acid, tetra(methylecarboxyl)methane, 1,2,7,8-octane tetracarboxylic acid, pyromellitic acid, empol trimer acid, and acid anhydrides and low-molecular alkyl esters thereof.

The binder resin used in the present invention may be a resin obtained by parallel reactions in the same vessel comprising a radical polymerization reaction of vinyl resin and a condensation polymerization reaction of a polyester resin using a raw monomer of polyester resin, raw monomer of vinyl resin and dual-reactive monomer. The dual-reactive monomer is a raw monomer that can use the dual reactions of the condensation polymerization and the radical polymerization. That is, the dual-reactive monomer has a carboxy group for the condensation polymerization and a vinyl group for the radical polymerization, e.g., fumaric acid, maleic acid, acrylic acid, methacrylic acid and the like.

The raw monomers of the polyester resin may have the aforesaid polyvalent alcohol component and polyvalent carboxylic acid component.

Examples of useful raw monomers of vinyl resin include styrene or styrene derivatives such as styrene, o-methylstyrene, m-methylstyrene, p-methylstyrene, α-methylstyrene, p-ethylstyrene, 2,4-dimethylstyrene, p-tert-butylstyrene, p-chlorostyrene and the like; ethylene unsaturated monoolefins such as ethylene, propylene, butylene, isobutylene and the like; alkyl ester methacrylates such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate, dodecylmethacrylate and the like; alkyl ester acrylates such as methylacrylate, n-propylacrylate, isopropylacrylate, n-butylacrylate, isobutylacrylate, t-butylacrylate, n-pentylacrylate, isopentylacrylate, neopentylacrylate, 3-(methyl) butylacrylate, hexylacrylate, octylacrylate, nonylacrylate, decylacrylate, undecylacrylate, dodecylacrylate and the like; and acrylonitile, maleic acid ester, itaconic acid ester, vinylchloride, vinyl acetate, vinylbenzoate, vinylmethylethyl ketone, vinylhexyl ketone, vinylmethyl ether, vinylethyl ether, vinylisobutyl ether and the like. Examples of useful polymerization initiators when polymerizing the raw monomers of vinyl resin include azo and diazo polymerization initiators such as 2,2'-azobis(2,4-dimethylvaleronitrile, 2,2'-azobisisobutylonitrile, 1,1'-azobis(cyclohexane-1-carbonitrile), 2,2'-azobis-4-methoxy-2,4-dimethylvaleronitrile and the like; and perioxide polymerization initiators such as benzoylperoxide, methylethylketone peroxide, isopropyl peroxycarbonate, lauroyl peroxide and the like.

In the present invention, it is desirable that the binder resin comprise two types of resins having different softening points so as to improve fixing characteristics, and to improve anti-offset characteristics. That is, it is desirable that a first resin having a softening point of 95 to 120° C. is used to improve fixing characteristics, and a second resin having a softening point of 130 to 160° C. is used to improve anti-offset characteristics. In this case, when the softening point of the first resin is less than 95° C., anti-offset characteristics are reduced and cause a reduction in dot reproducibility, and when the softening point is in excess of 120° C., there is inadequate improvement of fixing characteristics. When the softening point of the second resin is less than 130° C., there is inadequate improvement of anti-offset characteristics, and when the softening point is in excess of 160° C., fixing characteristics are reduced. From these perspectives, therefore, it is desirable that the softening point of the first resin is 100 to 115° C., and the softening point of the second resin is 135 to 155° C. It is further desirable that the glass transition temperatures of the first and second resins is 50 to 75° C., and preferably 55 to 70° C. When the glass transition temperature is less than 55° C., the toner has inadequate heat resistance, whereas when the glass transition temperature is higher than 70° C., pulverization characteristics during manufacture are lowered and cause a reduction in production efficiency.

It is desirable that the aforesaid first polyester resin should be a polyester resin produced by condensation polymerization of the aforesaid polyvalent alcohol component and polyvalent carboxylic acid component, and it is particularly desirable that the polyester resin has bisphenol-A alkylene oxide additive as a main polyvalent alcohol component, and at least one polyvalent carboxylic acid monomer selected from the group consisting of terephthalic acid, fumaric acid, dodecenylsuccinic acid, benzenetricarboxylic acid as a main polyvalent carboxylic acid component.

From the perspectives of improving wax dispersibility, toner strength, fixing characteristics, and anti-offset characteristics is desirable that the second resin should be the resin obtained by parallel reactions in the same vessel comprising the radical polymerization reaction of vinyl resin and the condensation polymerization reaction of a polyester resin using the raw monomer of polyester resin, the raw monomer of vinyl resin and the dual-reactive monomer. The vinyl resin content of the second resin is desirably 5 to 40 percent-by-weight, and preferably 10 to 35 percent-by-weight (hereinafter percent-by-weight is abbreviated to wt %). When the vinyl resin content is less that 5 wt %, polyethylene wax dispersibility is reduced, and toner fixing strength is reduced. When the vinyl resin content exceeds 40 wt %, polypropylene wax dispersibility is reduced, and anti-offset characteristics and toner strength are reduced, and lead to low negative charge level in the toner.

The weight ratio of the first resin to the second resin is desirably 7:3 to 2:8, and preferably 6:4 to 3:7. Using first and second resins within the aforesaid ranges produces excellent dot reproducibility by minimizing toner breakdown during fixing, and maintains excellent fixing characteristics even in image forming apparatuses operating at low and high speeds by having excellent low temperature fixing characteristics. Furthermore, excellent dot reproducibility is maintained even in the case of forming images on both sides of a sheet (i.e., passing through the fixing device twice). When the ratio of the first resin is less than the aforesaid range, low temperature fixing characteristics are inadequate and a broad range of fixing characteristics cannot be assured. When the ratio of the second resin is less than the aforesaid range, anti-offset characteristics are reduced, and dot reproducibility is tends to be reduced due to toner breakdown during fixing. The softening point of the resin was determined using a flow tester (model CFT-500; Shimazu Seisakusho); the softening point was designated as the temperature corresponding to ½ the height from the flow start point to the flow end point when a 1 $cm^3$ sample was melted under conditions of die pore size of 1 mm diameter by 1 mm length, pressure of 20 $kg/cm^2$, and temperature rise rate of 6° C./min. The glass transition temperature was measured using a differential scanning calorimeter(model DCS-200; Seiko Denshi) and alumina as a reference; a 10 mg sample was heated from 20 to 120° C. with a temperature rise rate of 10° C./min, and the shoulder value at the main endothermic peak was designated the glass transition temperature. The acid value of the resin is the value calculated from the uptake of a N/10 sodium hydroxide/alcohol solution by titrating a previously standardized N/10 sodium hydroxide/alcohol solution using 0.1% bromothymol blue and phenol red mixed indicator with 10 mg of sample material dissolved in 50 ml toluene.

Wax may be included in the toner of the present invention to improve characteristics such as anti-offset characteristics. Examples of useful waxes include polyethylene wax, polypropylene wax, carnuba wax, rice wax, sasol wax, montan ester wax, fischer-tropsch wax and the like. When such wax is included in the toner, the wax content is desirably 0.5 to 5 pbw relative to 100 pbw of binder resin to achieve effectiveness in preventing filming and the like.

It is desirable to include polypropylene wax in the toner from the perspective of improving anti-offset characteristics. It is further desirable to include polyethylene wax in the toner from the perspective of improving smear characteristics (i.e., smearing occurs when is blurred or soiled by a roller when fed by an autofeeder or when making a duplex copy with an image already formed on one side of the sheet). A particularly desirable polypropylene wax, from the aforesaid perspectives, will have a melt viscosity of 50 to 300 cps at 160° C., a softening point of 130 to 160° C., and an acid value of 1 to 20 KOHmg/g. A particularly desirable polyethylene wax will have a melt viscosity of 1,000 to 8,000 cps at 160° C., and a softening point of 130 to 150° C. The wax melt viscosity was measured using a Brookfield viscometer.

Magnetic powder or the like may be added to the toner of the present invention as necessary. Examples of useful magnetic powders include well-known fine magnetic particles such as ferrite, magnetite, iron and the like, and may be added from the perspective of preventing airborne dispersion of the toner; The amount of added magnetic powder is desirable 0.5 to 10 pbw, preferably 0.5 to 8 pbw, and more preferably 1 to 5 pbw, relative to 100 pbw of binder resin. When the amount of added magnetic powder exceeds 10 pbw, developing characteristics are reduced due to the strengthening of the magnetic flux force exerted the developer carrying member (within the magnet roller) on the toner.

It is desirable that hydrophobic silica and metal titanate are used as exterior additive particles in the present invention. Hydrophobic silica in this instance mean silica subjected to surface treatment via a hydrophobic agent such as silane coupling agent, silicone oil or the like. The metal titanate may have been surface-treated with the hydrophobic agent. Use of the hydrophobic silica and metal titanate improves charge stability relative to environmental fluctuations and prevents a loss of charge under high-temperature and high-humidity conditions. Specially, use of the hydrophobic silica and metal titanate improves charge stability relative to environmental fluctuations and prevents a loss of charge under 50° C.

The additive weight ratios of the hydrophobic silica particles and metal titanate particles (hydrophobic silica particles:metal titanate particles) is desirably within a range of 5:1 to 1:1.2, and preferably 3:1 to 1:0.8, and the exterior additive total specific surface area S is 40 to 120, and preferably 50 to 100, expressed by the equation (1) below:

$$S=Ss\times Vs+St\times Vt \quad (1)$$

(wherein Ss is the specific surface area of the hydrophobic silica ($m^2/g$), Vs is the additive amount (wt %) of hydrophobic silica particles relative to toner particles, St is the specific surface area of the metal titanate ($m^2/g$), and Vt is the additive amount (wt %) of metal titanate particles relative to toner particles).

In this case, when the total specific surface area S is less than 40, flow characteristics of toner and charge characteristics of toner are reduced, and when the total specific surface area S is in excess of 120, treatment of toner is difficult by excess of flow characteristics. When the ratio of the hydrophobic silica particles is more than the aforesaid range, toner charge stability relative to environmental fluctuations deteriorates and filming of photosensitive member occurs. When the ratio of the hydrophobic silica particles is less than the aforesaid range, charge rise characteristics deteriorates and a thickness of the photosensitive member decrease by toner-abrasion. By adding hydrophobic silica and metal titanate in a specific weight ratio, i.e., at a specific total specific surface area, toner flow characteristics, toner charge stability relative to environmental fluctuations, and transfer characteristics from the photosensitive member to the transfer sheet are markedly improved and fogging, filming of the photosensitive member and decrease of thickness of the photosensitive member are prevented during printing.

In the present invention, it is desirable that the hydrophobic silica have a BET specific surface area of 100 to 250 ($m^2/g$), and preferably 120 to 200 ($m^2/g$).

It is further desirable that the metal titanate have a BET specific surface area of 3 to 15 ($m^2/g$), and preferably 5 to 12 ($m^2/g$).

Examples of useful metal titanates include strontium titanate, barium titanate, calcium titanate and the like used individually or in combinations of two or more. It is desirable that the metal titanate have a mean primary particle size of 180 to 700 nm.

The toner particles in the present invention have a volume-average particle size of 3 to 9 $\mu$m, and preferably 6 to 9 $\mu$m, from the standpoint of high resolution image reproducibility.

The toner of the present invention may be used in a two-component developer together with a carrier, or in a monocomponent developer without a carrier. The carrier used in a two-component developer may be a well-known conventional carrier.

The present invention is described by way of experimental examples below, but is not limited to these experimental examples.

Production of Polyester Resins L

Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid, terephthalic acid, and fumaric acid were combined to achieve a weight ratio of 82:77:16:32:30. The mixture was introduced into a four-mouth flask to which a reflux condenser, nitrogen gas tube, thermometer, and mixing device were attached, then dibutyl tin oxide was added as a polymerization initiator. The material was heated in a mantle heater under a nitrogen atmosphere and reacted by mixing at 220° C. to obtain linear polyester resins L1–L3. The obtained polyester resin L1 had a softening point of 110° C., glass transition temperature of 60° C., and acid value of 17.5 KOHmg/g.

Production of Polyester Resins H

Styrene and 2-ethylhexylacrylate were combined at a weight ratio of 17:3.2, and dicumyl peroxide was introduced via a titration rod as a polymerization initiator. Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid terephthalic acid, anhydrous 1,2,4-benzenetricarboxylic acid, and acrylic acid were combined to achieve a weight ratio of 42:11:11:11:8:1, and the mixture was introduced into a four-mouth flask to which a reflux condenser, nitrogen gas tube, thermometer, and mixing device were attached, then dibutyl tin oxide was added as a polymerization initiator. The material was mixed in a mantle heater under a nitrogen atmosphere at 135° C. as the styrene/2-ethylhexylacrylate solution was titrated in via the titration rod, and thereafter the temperature was elevated and the materials were reacted at 230° C. to obtain polyester resins H. The obtained polyester resin H had a softening point of 150° C., glass transition temperature of 62° C., and acid value of 24.5 KOHmg/g. The polyester resin H was a resin containing polyester resin and vinyl resin.

Experimental Example 1

A mixture of 40 pbw polyester resin L, 60 pbw polyester resin H, 2 pbw polyethylene wax (800P; Mitsui Sekiyu Kagaku Kogyo; melt viscosity 5400 cps at 160° C., softening point: 140° C.), 2 pbw polypropylene wax (TS-200; Sanyo Kasei Kogyo; melt viscosity of 120 cps at 160° C., softening point: 145° C., acid value: 3.5 KOHmg/g), 8 pbw acidic carbon black (Mogul L; Cabot; pH2.5, mean primary particle size: 24 nm), and 2 pbw negative charge controller having the chemical structural formula below

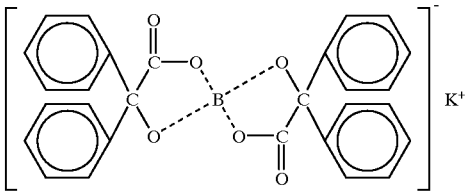

were added to a Henschel mixer and thoroughly mixed. The obtained mixture was fusion kneaded using a twin-shaft extrusion kneader, then cooled. The cooled mixture was coarsely pulverized using a hammer mill, and the coarsely pulverized material was finely pulverized using a jet mill, and then the material was then classified to obtain toner particles having a volume-average particle size of 7.5 $\mu$m.

These toner particles were mixed with 0.3 wt % hydrophobic silica microparticles having a BET specific surface area of 140 $m^2/g$ (H2000; Hoechst), and 0.1 wt % strontium titanate microparticles having a BET specific surface area of 9 $m^2/g$ (mean particle size of 350 nm) to obtain the end toner. The additive exterior microparticles of the toner had a total specific surface area of 42.9 $m^2/g$.

Experimental Example 2

Toner was produced in the same manner as in Experimental example 1 with the exception that the amount of added hydrophobic silica microparticles was changed to 0.5 wt %, and the amount of added strontium titanate microparticles was changed to 0.3 wt %. The additive exterior microparticles of the toner had a total specific surface area of 72.7 $m^2/g$.

Experimental Example 3

Toner was produced in the same manner as in Experimental example 1 with the exception that the amount of added hydrophobic silica microparticles was changed to 0.8 wt %, and the amount of added strontium titanate microparticles was changed to 0.8 wt %. The additive exterior microparticles of the toner had a total specific surface area of 119.2 $m^2/g$.

Experimental Example 4

Toner was produced in the same manner as in Experimental example 1 with the exception that the amount of added hydrophobic silica microparticles was changed to 0.5 wt %, and the amount of added strontium titanate microparticles was changed to 0.1 wt % of strontium titanate microparticles having a BET specific surface area of 5 $m^2/g$ (mean particle size of 700 nm). The additive exterior microparticles of the toner had a total specific surface area of 70.5 $m^2/g$.

Experimental Example 5

Toner was produced in the same manner as in Experimental example 1 with the exception that the amount of added hydrophobic silica microparticles was changed to 0.45 wt %, and the amount of added strontium titanate microparticles was changed to 0.5 wt % of strontium titanate microparticles having a BET specific surface area of 12 $m^2/g$ (mean particle size of 240 nm). The additive exterior microparticles of the toner had a total specific surface area of 69.0 $m^2/g$.

Experimental Example 6

Toner was produced in the same manner as in Experimental example 1 with the exception that the added hydrophobic silica was changed to 0.35 wt % of TS500 (Cabot; BET specific surface area: 225 $m^2/g$), and the amount of added strontium titanate microparticles was changed to 0.07 wt % of strontium titanate microparticles having a BET specific surface area of 5 $m^2/g$ (mean particle size of 700 nm). The additive exterior microparticles of the toner had a total specific surface area of 79.1 $m^2/g$.

Experimental Example 7

Toner was produced in the same manner as in Experimental example 6 with the exception that the amount of added hydrophobic silica microparticles was changed to 0.3 wt %, and the amount of added strontium titanate microparticles was changed to 0.3 wt % of strontium titanate microparticles having a BET specific surface area of 12 $m^2/g$ (mean particle size of 240 nm). The additive exterior microparticles of the toner had a total specific surface area of 71.1 $m^2/g$.

Experimental Example 8

Toner was produced in the same manner as in Experimental example 7 with the exception that the amount of added hydrophobic silica microparticles was changed to 0.5 wt %, and the amount of added strontium titanate microparticles was changed to 0.5 wt %. The additive exterior microparticles of the toner had a total specific surface area of 118.5 $m^2/g$.

Experimental Example 9

Toner was produced in the same manner as in Experimental example 1 with the exception that the amount of added hydrophobic silica microparticles was changed to 0.2 wt %, and the amount of added strontium titanate microparticles was changed to 0.1 wt %. The additive exterior microparticles of the toner had a total specific surface area of 28.9 $m^2/g$.

Experimental Example 10

Toner was produced in the same manner as in Experimental example 1 with the exception that the amount of added hydrophobic silica microparticles was changed to 0.9 wt %, and the amount of added strontium titanate microparticles was changed to 1.0 wt %. The additive exterior microparticles of the toner had a total specific surface area of 135.0 $m^2/g$.

Experimental Example 11

Toner was produced in the same manner as in Experimental example 4 with the exception that the amount of added hydrophobic silica microparticles was changed to 0.5 wt %, and the amount of added strontium titanate microparticles was changed to 0.05 wt %. The additive exterior microparticles of the toner had a total specific surface area of 70.3 $m^2/g$.

Experimental Example 12

Toner was produced in the same manner as in Experimental example 5 with the exception that the amount of added hydrophobic silica microparticles was changed to 0.5 wt %, and the amount of added strontium titanate microparticles was changed to 0.8 wt %. The additive exterior microparticles of the toner had a total specific surface area of 79.6 $m^2/g$.

Experimental Example 13

Toner was produced in the same manner as in Experimental example 6 with the exception that the amount of added hydrophobic silica microparticles was changed to 0.4 wt %, and the amount of added strontium titanate microparticles was changed to 0.05 wt %. The additive exterior microparticles of the toner had a total specific surface area of 90.3 $m^2/g$.

Experimental Example 14

Toner was produced in the same manner as in Experimental example 7 with the exception that the amount of added hydrophobic silica microparticles was changed to 0.35 wt %, and the amount of added strontium titanate microparticles was changed to 0.6 wt %. The additive exterior microparticles of the toner had a total specific surface area of 86.0 $m^2/g$.

Experimental Example 15

Toner was produced in the same manner as in Experimental example 7 with the exception that the amount of added hydrophobic silica microparticles was changed to 0.7 wt %, and the amount of added strontium titanate microparticles was changed to 0.6 wt %. The additive exterior microparticles of the toner had a total specific surface area of 164.7 $m^2/g$.

Experimental Example 16

Toner was produced in the same manner as in Experimental example 1 with the exception that 1.0 wt % of R809 (made by Nippon Aerosil Co., Ltd.; BET specific surface area: 50 $m^2/g$) was added as the hydrophobic silica, and the amount of added strontium titanate microparticles was changed to 0.4 wt %. The additive exterior microparticles of the toner had a total specific surface area of 53.6 $m^2/g$.

Experimental Example 17

Toner was produced in the same manner as in Experimental example 2 with the exception that azo dye T77 (made by Hodogaya Kagaku Co., Ltd.) was used as a negative charge controller. The additive exterior microparticles of the toner had a total specific surface area of 72.7 $m^2/g$.

Experimental Example 18

Toner was produced in the same manner as in Experimental example 2 with the exception that calix arene compound E89 (made by Orient Chemical Industries Co., Ltd.) was used a negative charge controller. The additive exterior microparticles of the toner had a total specific surface area of 72.7 $m^2/g$.

Experimental Example 19

Toner was produced in the same manner as in Experimental example 2 with the exception that quaternary ammonium salt with fluoride VP434 (made by Hoechst Co., Ltd.) was used as a negative charge controller. The additive exterior microparticles of the toner had a total specific surface area of 72.7 $m^2/g$.

Experimental Example 20

Toner was produced in the same manner as in Experimental example 2 with the exception terpene diphenol compound YP90 (made by Yasuhara Chemicals Co., Ltd.) was used as a negative charge controller. The additive exterior microparticles of the toner had a total specific surface area of 72.7 $m^2/g$.

The aforesaid toners were evaluated and the evaluation results are shown in Tables 1 and 2.

Toner Flow Characteristics

The apparent specific gravity of each toner was measured using a power tester (made by Hosokawa Micron Co., Ltd.). An apparent specific gravity of 0.42 cc/g and higher was ranked O, 0.38 cc/g and higher but less than 0.42 cc/g was ranked Δ, and less than 0.38 cc/g was ranked X.

Environmental Resistance 1.5 g of each of the aforesaid toners were mixed with 28.5 g of a pure carrier (used in a digital copier model Di 30; made by Minolta Co., Ltd.) at a toner-to-carrier weight ratio of 5:95 to produce developer. Each of the aforesaid developers was loaded in a plastic bottle of 50 cc and rotated at 120 rpm on a ball mill table to mix for 30 minutes.

Each of the aforesaid developers was subjected to charge measurements after the developers were left under conditions of high temperature and high humidity (H/H; 30° C., 85%RH) for three hours, and under conditions low temperature and low humidity (L/L; 10° C., 15%RH) for three hours. An absolute value of the difference in the H/H and L/L charges of less than 10 $\mu c$ was ranked O, a value of 10 $\mu c$ and higher but less than 15 $\mu c$ was ranked Δ, and a value of 15 $\mu c$ or higher was ranked X.

Transfer Characteristics 1.5 g of each of the aforesaid toners were mixed with 28.5 g of a pure carrier (used in a digital copier model Di 30; made by Minolta Co., Ltd.) at a toner-to-carrier weight ratio of 5:95 to produce developer. Each of the aforesaid developers was loaded in a plastic bottle of 50 cc and rotated at 120 rpm on a ball mill table to mix for 30 minutes.

Each of the aforesaid developers was used to make 3,000 printings using a model Di30 digital copier (Minolta Co., Ltd.), and the images were visually inspected. An Image without loss due to insufficient transfer was ranked O, slight image loss which posed not practical problem was ranked Δ, and serious image loss unsuitable for practical use was ranked X.

Charge Rise Characteristics 1.5 g of each of the aforesaid toners were mixed with 28.5 g of a pure carrier (used in a digital copier model Di 30;

made by Minolta Co., Ltd.) at a toner-to-carrier weight ratio of 5:95 to produce developer.

Each of the aforesaid developers was loaded in a plastic bottle of 50 cc and rotated at 120 rpm on a ball mill table to mix for 5, 10, 30, 60, 120, and 780 minutes, after which the amount of charge was measured (under environmental conditions of 25° C., 45%RH).

The amount of charge after 5 min relative to a maximum charge value {(amount of charge after 5 min/maximum charge value)×100} of 90% or greater was deemed an extraordinary excellent charge rise and designated by a rank of O, 80% and higher but less than 90% was deemed suitable for practical use and designated by a rank of Δ, and less than 80% was deemed unsuitable for practical use and designated by a rank of X.

Charge Characteristics Under High Temperature 1.5 g of each of the aforesaid toners were mixed with 28.5 g of a pure carrier (used in a digital copier model Di 30; made by Minolta Co., Ltd.) at a toner-to-carrier weight ratio of 5:95 to produce developer.

Each of the aforesaid developers was loaded in a plastic bottle of 50 cc and left under 50° C. of high temperature condition for two hours. Each of the aforesaid developers was rotated at 120 rpm on a ball mill table to mix for 10 minutes, after which the amount of charge was measured (under environmental conditions of 50° C.).

The amount of charge value after mixing for 10 min. at 50° C. relative to the amount of charge value after mixing for 10 min. at 25° C. in the Charge Rise Characteristics {(amount of charge after 10 min. at 50° C./amount of charge after 10 min. at 25° C. )×100} of 80% or greater was deemed an excellent charge keep under high temperature and designated by a rank of O, 70% and higher but less than 80% was deemed suitable for practical use and designated by a rank of Δ, and less than 70% was deemed unsuitable for practical use and designated by a rank of X.

Initial Fog and Post-printing Fog 1.5 g of each of the aforesaid toners were mixed with 28.5 g of a pure carrier (used in a digital copier model Di 30; made by Minolta Co., Ltd.) at a toner-to-carrier weight ratio of 5:95 to produce developer.

Each of the developers was used to make 100,000 prints using a model Di30 digital copier, and the images were visually examined at initial printing (after 100 sheets) and at the end of printing. Images with no trace of fog were ranked O, images with slight fog that posed no practical problem were ranked Δ, and images with noticeable fog making them unsuitable for practical use were ranked X.

Filming Property of Photosensitive Member 1.5 g of each of the aforesaid toners were mixed with 28.5 g of a pure carrier (used in a digital copier model Di 30; made by Minolta Co., Ltd.) at a toner-to-carrier weight ratio of 5:95 to produce developer.

Each of the developers was used to make 100,000 prints using a model Di30 digital copier, and the photosensitive member was visually evaluated. The filming properties were indicated by O when no film-formation was observed on the surface of the photosensitive member, Δ when slight film-formation was produced, and X when a lot of film-formation was produced.

Decreasing Thickness of Photosensitive Member 1.5 g of each of the aforesaid toners were mixed with 28.5 g of a pure carrier (used in a digital copier model Di 30; made by Minolta Co., Ltd.) at a toner-to-carrier weight ratio of 5:95 to produce developer.

Each of the developers was used to make 100,000 prints using a model Di30 digital copier, and the decrease of the thickness of the photosensitive member was measured. The decrease of less than 6.5 μm was designated by a rank of 0, 6.5 μm and higher but less than 8.0 μm was designated by a rank of Δ, and 8.0 μm and higher was deemed unsuitable for practical use and designated by a rank of X.

TABLE 1

| | Toner Flow | Environ-mental Resistance | Trans-fer | Charge Rise | Charge Characteristics Under High Temperature |
|---|---|---|---|---|---|
| Ex. 1 | Δ | ○ | ○ | ○ | Δ |
| Ex. 2 | ○ | ○ | ○ | ○ | ○ |
| Ex. 3 | Δ | Δ | ○ | ○ | ○ |
| Ex. 4 | ○ | Δ | ○ | ○ | ○ |
| Ex. 5 | ○ | ○ | ○ | ○ | ○ |
| Ex. 6 | ○ | ○ | ○ | ○ | Δ |
| Ex. 7 | ○ | ○ | ○ | ○ | ○ |
| Ex. 8 | ○ | ○ | ○ | ○ | ○ |
| Ex. 9 | x | ○ | x | x | Δ |
| Ex. 10 | x | x | ○ | ○ | ○ |
| Ex. 11 | ○ | x | ○ | ○ | x |
| Ex. 12 | Δ | ○ | ○ | x | ○ |
| Ex. 13 | ○ | x | ○ | ○ | x |
| Ex. 14 | ○ | ○ | x | x | ○ |
| Ex. 15 | x | x | ○ | ○ | ○ |
| Ex. 16 | x | ○ | ○ | x | ○ |
| Ex. 17 | ○ | Δ | ○ | x | ○ |
| Ex. 18 | ○ | ○ | ○ | x | ○ |
| Ex. 19 | ○ | ○ | ○ | x | ○ |
| Ex. 20 | ○ | ○ | ○ | x | ○ |

TABLE 2

| | Initial Fog | Post-Print Fog | Filming Property | Decreasing Thickness |
|---|---|---|---|---|
| Ex. 1 | ○ | ○ | Δ | ○ |
| Ex. 2 | ○ | ○ | ○ | ○ |
| Ex. 3 | ○ | ○ | ○ | ○ |
| Ex. 4 | ○ | Δ | ○ | ○ |
| Ex. 5 | ○ | ○ | ○ | ○ |
| Ex. 6 | ○ | Δ | Δ | ○ |
| Ex. 7 | ○ | ○ | ○ | ○ |
| Ex. 8 | ○ | ○ | ○ | ○ |
| Ex. 9 | x | x | x | ○ |
| Ex. 10 | ○ | ○ | ○ | x |
| Ex. 11 | ○ | x | x | ○ |
| Ex. 12 | ○ | Δ | ○ | Δ |
| Ex. 13 | ○ | x | x | ○ |
| Ex. 14 | ○ | Δ | ○ | ○ |
| Ex. 15 | ○ | ○ | ○ | ○ |
| Ex. 16 | Δ | Δ | ○ | x |
| Ex. 17 | ○ | Δ | ○ | ○ |
| Ex. 18 | x | x | ○ | ○ |
| Ex. 19 | ○ | x | ○ | ○ |
| Ex. 20 | Δ | x | Δ | ○ |

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A negatively chargeable toner for developing electrostatic latent images comprising:

negatively chargeable toner particles including a binder resin having an acid value of 5 to 50 KOHmg/g, a colorant, and a boron compound represented by a structural formula (A);

(A)

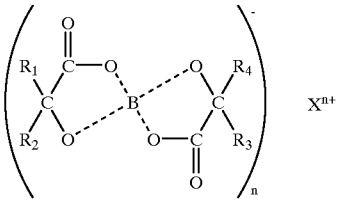

wherein $R_1$ and $R_3$ respectively represent substituted or non-substituted aryl group, $R_2$ and $R_4$ respectively represent hydrogen atom, alkyl group, substituted or non-substituted aryl group, X represents a cation, and n is an integer of either 1 or 2; and exterior additive particles adhered to the surface of the toner particle, said exterior additive particles comprising hydrophobic silica particles having a specific surface area of 100 to 250 $m^2/g$ and metal titanate particles having a specific surface area of 3 to 15 $m^2/g$, wherein the additive weight ratio of said hydrophobic silica particles and metal titanate particles is within a range of 5:1 to 1:1.2, a total specific surface area S of the exterior additive particles is 40 to 120 expressed by the equation (1):

$$S=Ss\times Vs+St\times Vt \quad (1)$$

wherein Ss is the specific surface area of the hydrophobic silica particles ($m^2/g$) , Vs is an additive amount of hydrophobic silica particles relative to the toner particles (percent-by-weight), St is the specific surface area of the metal titanate particles ($m^2/g$), and Vt is an additive amount of metal titanate particles relative to the toner particles (percent-by-weight).

2. The negatively chargeable toner of claim 1, wherein an amount of the boron compound is from 0.5 to 5 parts by weight per 100 parts by weight of the binder resin.

3. The negatively chargeable toner of claim 1, wherein said additive weight ratio is within a range of 3:1 to 1:0.8, and said total specific surface area S is 50 to 100.

4. The negatively chargeable toner of claim 1, wherein the colorant is a carbon black having a pH value of 1 to 6.

5. The negatively chargeable toner of claim 4, wherein an amount of the carbon black is from 6 to 12 parts by weight per 100 parts by weight of the binder resin.

6. The negatively chargeable toner of claim 4, wherein the carbon black has a mean primary particle size of 10 to 40 nm.

7. The negatively chargeable toner of claim 1, wherein the binder resin comprises a first resin and a second resin, said first resin having a softening point of 95 to 120° C. and a glass transition point of 50 to 75° C., and said second resin having a softening point of 130 to 160° C. and a glass transition point of 50 to 75° C.

8. The negatively chargeable toner of claim 7, wherein a weight ratio of the first resin to the second resin is 7:3 to 2:8.

9. The negatively chargeable toner of claim 7, wherein the first resin comprises a polyester resin obtained by a polyvalent alcohol component and a polyvalent carboxylic acid component, said polyester resin comprising a bisphenol-A alkylene oxide additive as the polyvalent alcohol component and at least one polyvalent carboxylic acid monomer selected from the group consisting of a terephthalic acid, a fumaric acid, a dodecenylsuccinic acid and a benzenetricarboxylic acid as the polyvalent carboxylic acid component.

10. The negatively chargeable toner of claim 7, wherein the first resin comprises a linear polyester resin obtained by a bivalent alcohol component and a bivalent carboxylic acid component.

11. The negatively chargeable toner of claim 7, wherein the second resin comprises a polyester resin obtained by a polyvalent alcohol component and a polyvalent carboxylic acid component, said polyester resin comprising a bisphenol-A alkylene oxide additive as the polyvalent alcohol component and at least one polyvalent carboxylic acid monomer selected from the group consisting of a terephthalic acid, a fumaric acid, a dodecenylsuccinic acid and a benzenetricarboxylic acid as the polyvalent carboxylic acid component.

12. The negatively chargeable toner of claim 7, wherein the second resin comprises a polyester resin and a vinyl resin.

13. The negatively chargeable toner of claim 7, wherein the second resin is obtained by a raw monomer of the polyester resin, a raw monomer of the vinyl resin and a dual-reactive monomer, said dual-reactive monomer being a raw monomer that is able to use dual reactions of a condensation polymerization and a radical polymerization.

14. The negatively chargeable toner of claim 13, wherein the dual-reactive monomer has a carboxyl group and a vinyl group.

15. The negatively chargeable toner of claim 12, wherein an amount of the vinyl resin of the second resin is from 5 to 40 percent by weight on the basis of the second resin.

16. The negatively chargeable toner of claim 1, comprising a wax contained in an amount of 0.5 to 5 parts by weight per 100 parts by weight of the binder resin.

17. The negatively chargeable toner of claim 16, wherein the wax is a mixture of a polypropylene wax and a polyethylene wax.

18. The negatively chargeable toner of claim 1, comprising magnetic particles being contained in an amount of 0.5 to 10 parts by weight per 100 parts by weight of the binder resin.

* * * * *